US005324153A

United States Patent [19]

Chess

[11] Patent Number: 5,324,153

[45] Date of Patent: Jun. 28, 1994

[54] PROCESS FOR MANUFACTURE OF SHEETS WITH SEPARABLE SELF-ADHESIVE LABELS

[75] Inventor: Stanley C. Chess, Jerome, Id.

[73] Assignee: Moore Business Forms, Inc., Grand Island, N.Y.

[21] Appl. No.: 966,840

[22] Filed: Oct. 27, 1992

[51] Int. Cl.[5] ..... B42B 9/00

[52] U.S. Cl. ..... 412/9; 156/250; 283/81

[58] Field of Search ..... 156/250, 257; 283/81, 283/101; 412/9, 16; 428/41; 40/299

[56] References Cited

U.S. PATENT DOCUMENTS

| | | | |
|---|---|---|---|
| 4,110,502 | 8/1978 | Baer | 428/40 |
| 4,379,573 | 4/1983 | Lomeli et al. | 428/42 |
| 4,799,712 | 1/1989 | Biava et al. | 282/1 A |
| 4,821,439 | 4/1989 | Wilck | 40/638 |
| 4,854,610 | 8/1989 | Kwiatek | 282/11.5 |
| 4,890,862 | 1/1990 | Buchholz | 283/62 |
| 4,910,058 | 3/1990 | Jameson | 428/42 |
| 4,978,415 | 12/1990 | Jones | 156/517 |
| 4,983,438 | 1/1991 | Jameson | 428/42 |
| 5,011,559 | 4/1991 | Felix | 156/257 |
| 5,031,938 | 7/1991 | Instance | 283/81 |
| 5,061,334 | 10/1991 | Paules | 156/235 |
| 5,129,682 | 7/1992 | Ashby | 283/81 |
| 5,203,851 | 4/1993 | Browning et al. | 283/81 |

OTHER PUBLICATIONS

Hans Neschen, Neschen International, brochures, 1977, 1978 (In German language, with English language explanation).

*Primary Examiner*—Timothy V. Eley
*Assistant Examiner*—William Fridie, Jr.
*Attorney, Agent, or Firm*—Nixon & Vanderhye

[57] ABSTRACT

Business forms having labels integral with the sheets there of (rather than riding piggyback thereon) are produced by applying a strip of transfer tape to only a portion of the second face of a sheet, with the adhesive of the transfer tape contacting the sheet, so that sheet material surrounds the transfer tape strip completely. Then a label is die cut from the first face of the sheet, preferably after the transfer tape is applied, within the area of the sheet overlying the transfer tape strip, without cutting the transfer tape backing. Indicia is at some point printed on the first face of the sheet. The label may be readily removed, with the adhesive from the transfer tape sticking to the label while the backing of the transfer tape remains in place. The strip of transfer tape is cut from a web, and then is transported with the adhesive face outward by a vacuum cylinder, until it moves into contact with a moving web. The web is ultimately formed into individual or continuous business forms, which may be multi-ply.

18 Claims, 2 Drawing Sheets

Fig. 2
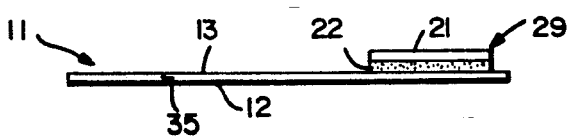
Fig. 3
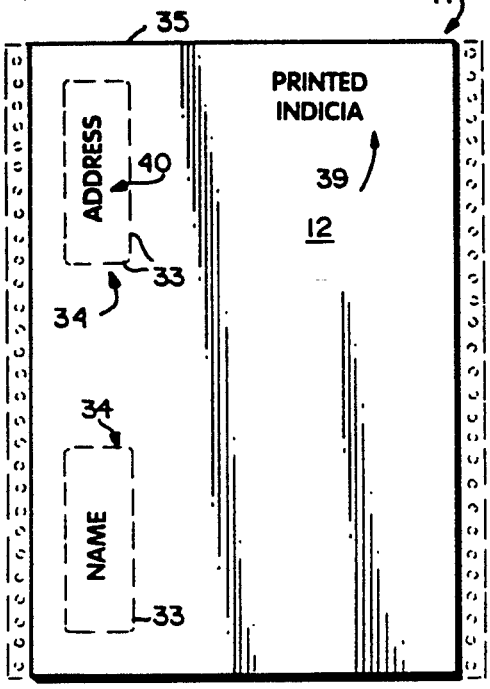
Fig. 4
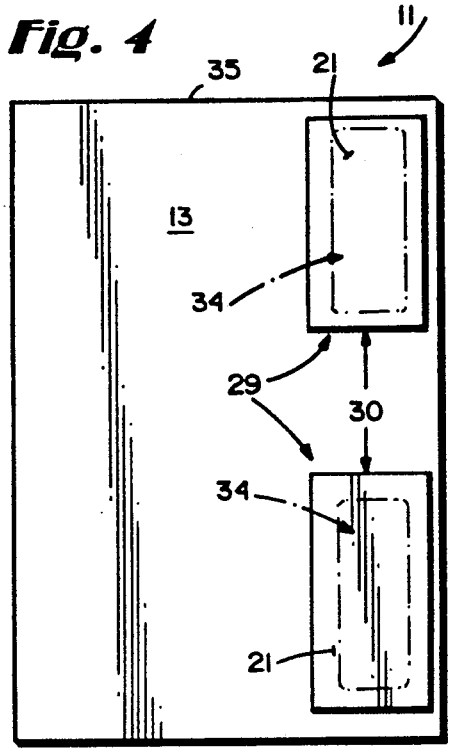
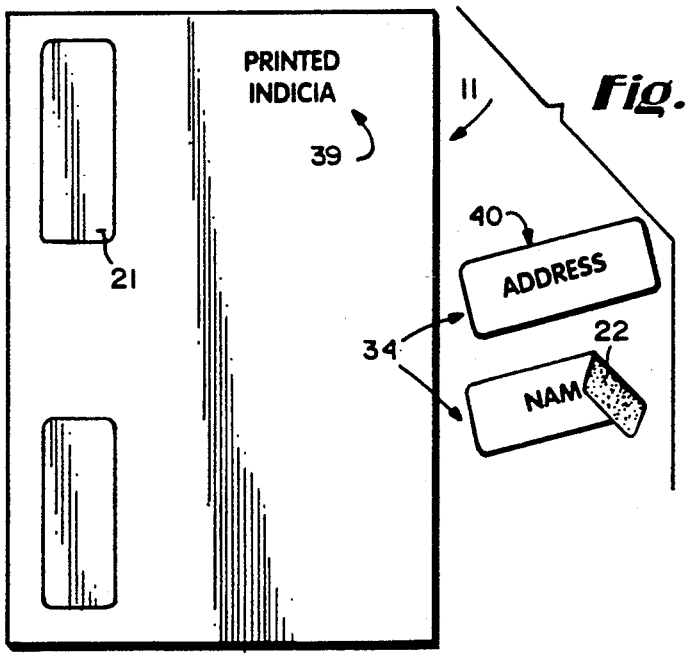
Fig. 5
Fig. 6
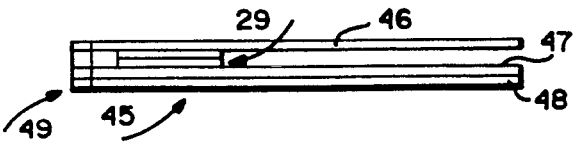

PROCESS FOR MANUFACTURE OF SHEETS WITH SEPARABLE SELF-ADHESIVE LABELS

BACKGROUND AND SUMMARY OF THE INVENTION

In the manufacture of business forms, there are many circumstances in which it is desirable to form an integral, but ultimately separable, self-adhesive label as a part of one or more sheets of the business form. According to the invention, this desirable goal is accomplished in a simple and straightforward manner with a minimum of equipment and a minimum of processing steps. The apparatus used to practice the invention is basically conventional apparatus which is modified only in small ways in order to perform the desired function, in producing business forms according to the invention.

According to one aspect of the present invention, a method of producing a business form having an integral label (or a plurality of labels) associated therewith is practiced utilizing a sheet having a first face capable of receiving printing thereon, and a second face having a greater affinity for transfer tape adhesive than does transfer tape backing. Transfer tape is a relatively-inexpensive and commonly-available product that is simple to handle, and readily utilized to form the labels according to the invention.

According to the method of the invention, in acting on a sheet (e.g., in web form) of paper having first and second faces the following steps are practiced: (a) Applying a strip of transfer tape to only a portion of the second face of the sheet with the transfer tape adhesive contacting the sheet, so that sheet material completely surrounds the transfer tape strip. (b) Before or after step (a), die cutting a label on a portion of the first face of the sheet within the area of the sheet overlying the transfer tape strip on the second face of the sheet, without cutting the transfer tape backing. (If step (b) does come before step (a), then the die cut should include small ties to hold the label in place.) And, (c) printing indicia on the first face of the sheet. Step (c) typically practiced before steps (a) and (b), or between steps (a) and (b), and initially the sheet is typically in continuous format, that is, in the form of a web of paper, during the practice of steps (a) through (c), and there is the further step (d) of separating the web into individual sheets, each individual sheet containing at least one label. Step (a) is typically practiced by: (i) cutting a strip of transfer tape from a web of transfer tape; and (ii) transporting the strip to the sheet with adhesive facing outwardly, and applying the strip to the second face of the sheet, using a vacuum cylinder. Step (b) is typically practiced by die cutting a label from completely within the area of the sheet overlying the transfer tape.

To utilize the integral label formed according to the invention, it is merely necessary to remove it from the form by peeling it away from the transfer tape backing, the adhesive of the transfer tape remaining with the label, i.e., separating from the transfer tape backing.

The invention also comprises apparatus for producing a business form having an integral removal label. The apparatus includes means for transporting a sheet of material (typically paper) having first and second faces in a first direction, and utilizes a web of transfer tape having a backing and adhesive on one face of the backing. To apply the transfer tape to the web, a conventional labeling machine—such as a Tamarak machine, only modified to have some to the rollers thereof coated with a release material (silicone-coated) in order to properly deliver the transfer tape to the web—is utilized. The Tamarak machine includes means for cutting a strip of transfer tape from the web of transfer tape, and a vacuum cylinder for transporting cut strips of transfer tape away from the cutting means so that the adhesive of the transfer tape faces away from the vacuum cylinder. There are also means for positioning the vacuum cylinder with respect to the means for transporting the sheet so that the cut strip of transfer tape is applied to the second face of the sheet. Also, there typically is means—preferably downstream from the vacuum cylinder in the direction of movement of the web—for die cutting the label from the sheet on a first face thereof, overlying the transfer tape strip on the second face of the sheet (without cutting the transfer tape backing); and printing means are provided for printing indicia on the front face of the sheet. The cutting means may comprise a cut-off cylinder positioned with respect to the vacuum cylinder so that the vacuum cylinder comprises an anvil for the cut-off cylinder. When the sheet is in continuous format, means are provided, downstream of the rest of the apparatus, for severing the paper web into individual sheets. Perfing means may be provided upstream of the vacuum cylinder, and the transfer tape may be fed to the vacuum cylinder over roller means comprising at least one roller having a release surface (silicone-coated) of material which will not adhere to the transfer tape adhesive.

The invention also relates to a single part, or multipart, business form with at least one sheet (ply) with at least one integral label formed from the sheet, the business form produced from the method steps described above.

It is the primary object of the present invention to provide a simple, yet effective, method and apparatus for producing a business form having an integral label associated therewith. This and other objects of the invention will become clear from an inspection of the detailed description of the invention and form the appended claims.

BRIEF DESCRIPTION OF THE DRAWINGS

FIG. 2 is an end view of an exemplary business form produced according to the invention, with the thickness of the components greatly exaggerated for clarity of illustration;

FIGS. 3 and 4 are top and bottom views, respectively, of a business form like that of FIG. 2;

FIG. 5 is a view like that of FIG. 3 only showing the labels removed; and FIG. 6 is a side view of an exemplary multipart business form produced according to the present invention, with the thickness of the components greatly exaggerated for clarity of illustration.

DETAILED DESCRIPTION OF THE DRAWINGS

Figure 1:
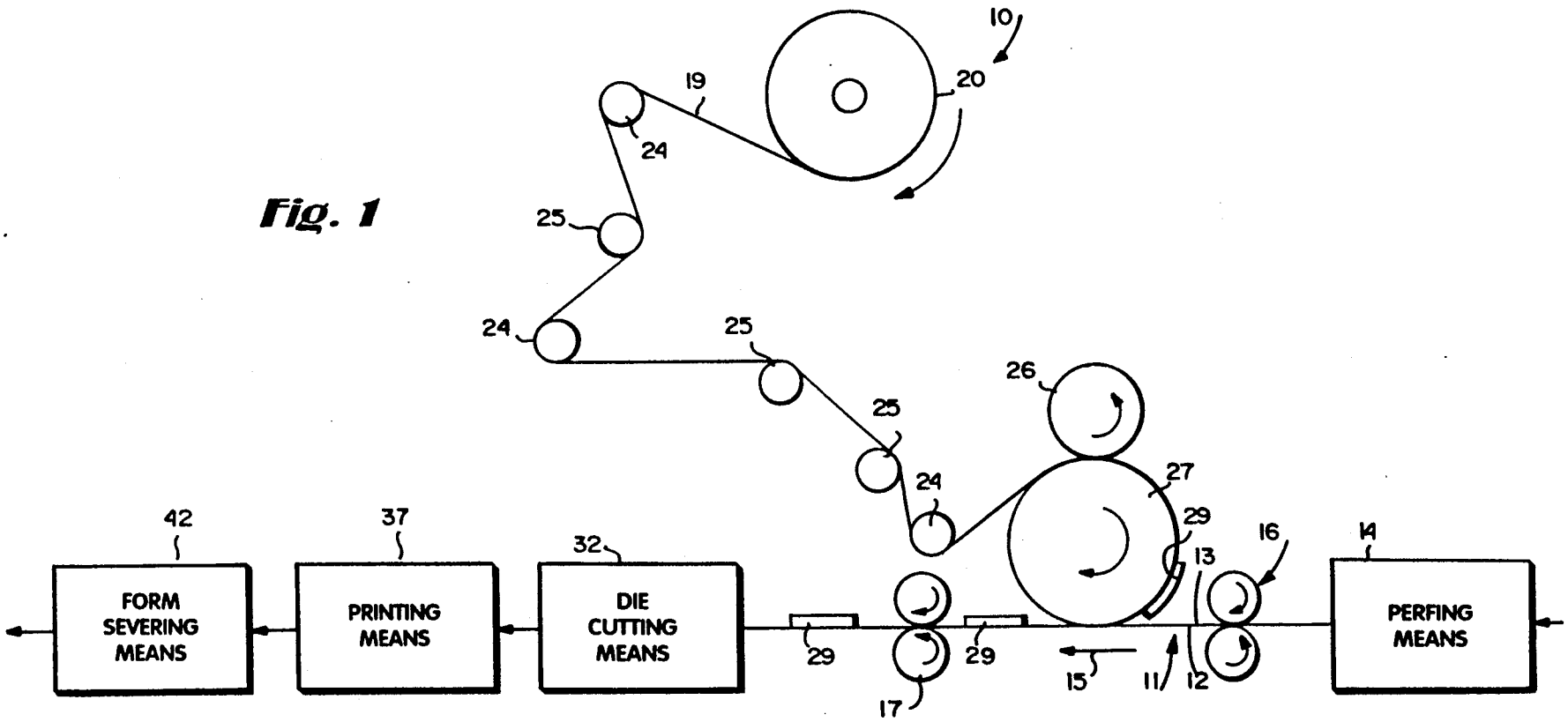
FIG. 1 is a schematic view of exemplary apparatus for producing business forms with integral labels according to the present invention.

Exemplary apparatus for practicing exemplary methods according to the present invention is illustrated generally at 10 in FIG. 1. The apparatus 10 acts on a sheet 11, which typically is in the form of a web having a first face 12 and a second face 13, the web ultimately formed into individual business forms at some stage in the processing. The sheet 11 typically is of bond paper, although it may be of other sheet material having desired characteristics. If desired, conventional perling means 14 may be provided at the upstream-most portion of the web 11 which moves in the direction 15, to form individual forms from the web 11.

Means are provided for transporting the sheet of web material 11 in the direction 15. Such transporting means typically comprise a plurality of pairs of powered tractors, as indicated schematically at 16 and 17 in FIG. 1.

In order to provide a label integral with the sheet 11, according to the present invention, conventional transfer tape 19, which is taken off from a tape roll 20, is cut into strips which are then applied, in space relationship, to the second face 13 of the sheet 11. To accomplish this, the conventional transfer tape 19—which includes a backing 21 and an adhesive 22 on one face thereof (see FIG. 2)—is taken off of the roll 20 with the adhesive face outward. The tape 19 is then fed by a plurality of rollers, including the rollers 24 which have the surfaces thereof coated with a release material so that the adhesive 22 from the transfer tape 19 will not adhere thereto (such as a silicone-coating), and also guided by other rollers 25, is ultimately fed to a cut-off cylinder 26 cooperating with a vacuum cylinder 27. The cut-off cylinder cuts the web 19 of transfer tape into individual strips 29, as seen in FIGS. 1, 2 and 4, which are applied to the second face 13 of the sheet 11. The second face 13 has a higher affinity for the adhesive 22 of the transfer tape strips 29 than does the backing 21. Virtually all typical bond papers have such affinity.

The basic apparatus 10 may comprise a conventional Tamarak labelling machine, only modified to have the silicone-coated rollers 26. The cut-off cylinder 26 cooperates with the vacuum cylinder 27, with the vacuum cylinder 27 forming an anvil for the cylinder 26. The bearing for mounting the vacuum cylinder 27 (and cut-off cylinder 26) with respect to the transporting means 16, 17, mount the cylinder 27 so that the strips 29 are applied to the face 13 as the sheet 11 moves in direction 15.

When a strip 29 is applied to the back face 13 of the sheet 11, the strip 29 is completely surrounded by the sheet material 11 as seen in FIG. 4, and the strips 29 are spaced from each other—as indicated by reference numeral 30 in FIG. 4—in the direction 15. Typically only one strip 29 may be provided for each sheet 11 that ultimately is formed into an individual business form; however, two (or even more) strips 29 may be provided in association with one sheet 11 if desired.

Spaced from the vacuum cylinder 27—shown downstream in the direction 15—a die-cutting cutting means 32 (see FIG. 1) is preferably provided. The die cutting means 32 may alternatively be upstream of the cylinder 27 (in which case the die cut then formed should include small ties to hold the label in place for subsequent processing). The conventional die-cutting means 32 acts on face 12 to cut through the material forming the sheet 11 to cut a label out of the sheet 11. However, die-cutting means 32 does not cut the backing 21 of the transfer tape. As seen in FIG. 3, die-cut separation lines are illustrated by reference numeral 33, and the labels formed therefrom are illustrated by reference numeral 34. The die-cutting lines 33 are positioned so that they overlie the backing 21 of the transfer tape strips 29. Typically, the die-cut lines 33 are completely within the area of the transfer tape backing 21, at least at the "top" and "bottom" of the sheets 11 (the "top" or leading edge of the sheet 11 is shown by reference numeral 35 in FIGS. 3 and 4), and preferably also along the side edges too.

A printing means 37 is also associated with the other apparatus of FIG. 1. The printing means 37 prints the first face 12 of the material 11, the first face 12 being receptive to printing (as virtually all bond paper is). The indicia printed thereon is seen at 39 in FIGS. 3 and 5, and also typically includes indicia 40 on the labels 34. The printing means 37 may be positioned as illustrated in FIG. 1, but preferably is disposed before the cylinder 27, or between cylinder 27 and die cutting means 32.

Where, as is typical, the sheet of material 11 is in continuous form during the performance of these operations, an individual form-severing means 42—see FIG. 1—may be provided downstream of the rest of the components (e.g. 27, 32, 37). Alternatively, the forms could be delivered in continuous format and separated by the ultimate user.

When the sheets 11 are utilized according to the invention, it is merely necessary to separate the labels 34 from the rest of the sheet 11 at the die-cut lines 33. Because the labels 34 have a higher affinity for the adhesive 22 than does the backing 21, the backing 21 remains (see FIG. 5) while the labels 34 have the adhesive 22 on the back thereof, as illustrated for the lowermost of the separated labels 34 in FIG. 5.

During conventional processing, other conventional techniques and mechanisms may also be utilized, such as the removable tractor drive strips shown in dotted line on the opposite sides of the sheet 11 in FIG. 3.

Also, multipart forms may be produced. FIG. 6 illustrates a multipart form 45 produced according to the invention. In the multipart form illustrated in FIG. 6, the top component 46 (or an interior ply of the form, such as the second ply of a three ply construction) comprises paper with a transfer tape strip 29 on the back thereof and a label (not shown but like the labels 34) formed on the top thereof. A number of additional sheets 47, 48 which may be connected together—as indicated at 49 at one end thereof—are also provided, in any desired order. Alternatively, instead of the construction as illustrated in FIG. 6, each of the plays 46 through 48 may have an integral label or labels associated therewith.

In the utilization of the apparatus 10, strips 29 of transfer tape are applied to a portion of the second face 13 of the sheets 11 so that the transfer tape adhesive 22 contacts the sheet 11 face 13 and so that sheet material surrounds the transfer tape strips 29. After this step, the individual integral labels 34 are die-cut from the first face 12 of the sheet 11 within the area of the sheet overlying the transfer tape strip 29 on the second face 13, without cutting the transfer tape backing. Indicia 39 is printed on the first face 12, typically downstream of the vacuum cylinder which applies the strips 29.

It will thus be seen that according to the present invention, a simple, yet effective, method and apparatus have been provided, as well as a business form with integral label produced thereby, utilizing only simple equipment and readily available components to construct the business form.

While the invention has been herein shown and described in what is presently conceived to the most practical and preferred embodiment, it will be apparent to those of ordinary skill in the art that many modifications may be made thereof within the scope of the invention, which scope is to be accorded the broadest interpretation of the appended claims so as to encompass all equivalent methods, apparatus, and forms.

What is claimed is:

1. A method of producing a business form having an integral label associated therewith, from a sheet having a first face capable of receiving printing thereon, and a second face having a greater affinity for transfer tape adhesive than transfer tape backing, comprising the steps of:

(a) applying a strip of transfer tape to only a portion of the second face of the sheet with the transfer tape adhesive contacting the sheet, so that sheet material completely surrounds the transfer tape strip;

(b) die cutting a label on a portion of the first face of the sheet within the area of the sheet ultimately overlying the transfer tape strip on the second face of the backing sheet; and (c) printing indicia on the first face of the sheet.

2. A method as recited in claim 1 wherein step (c) is practiced before steps (a) and (b).

3. A method as recited in claim 1 wherein step (c) is practiced between steps (a) and (b).

4. A method as recited in claim 1 wherein step (b) is practiced after step (a), without cutting the transfer tape backing.

5. A method as recited in claim 1 wherein step (b) is practiced before step (a), and to leave ties holding the label to the sheet.

6. A method as recited in claim 1 wherein the sheet is in continuing format in the form of a web of paper, during the practice of steps (a)–(c), and comprising the further step (d), after steps (a)–(c), of separating the web into individual sheets, each individual sheet containing at least one label.

7. A method as recited in claim 1 wherein step (a) is practiced by:

(i) cutting a strip of transfer tape from a web of transfer tape; and (ii) transporting the strip to the sheet with adhesive facing outwardly, and applying the strip to the second face of the sheet, using a vacuum cylinder.

8. A method as recited in claim 4 wherein step (b) is practiced by die cutting the label from completely within the area of the sheet overlying the transfer tape.

9. A method as recited in claim 4 comprising the further step of removing the die cut label from the form by peeling it away from the transfer tape backing, the adhesive of the transfer tape remaining with the label and separating from the transfer tape backing.

10. A method as recited in claim 9 wherein step (b) is practiced by die cutting the label from completely within the area of the sheet overlying the transfer tape.

11. A method as recited in claim 4 wherein the sheet is in continuing format in the form of a web of paper, during the practice of steps (a)–(c), and comprising the further step (d), after steps (a)–(c), of separating the web into individual sheets, each individual sheet containing at least one label.

12. A method as recited in claim 8 wherein step (a) is practiced by:

(i) cutting a strip of transfer tape from a web of transfer tape; and (ii) transporting the strip to the sheet with adhesive facing outwardly, and applying the strip to the second face of the sheet, using a vacuum cylinder.

13. Apparatus for producing a business form having an integral removable label, comprising:

means for transporting a sheet of material, having first and second faces, in a first direction;

a web of transfer tape, having a backing and adhesive on one face of the backing;

means for cutting a strip of transfer tape from the web of transfer tape;

a vacuum cylinder for transporting cut strips of transfer tape away from the cutting means with the adhesive of the transfer tape facing away from the vacuum cylinder;

means for positioning said vacuum cylinder with respect to said means for transporting the sheet so that the cut strip of transfer tape is applied to the second face of the sheet;

means for die cutting a label from the sheet on the first face thereof, ultimately overlying the transfer tape strip on the second face of the sheet; and printing means for printing indicia on the front face of the sheet.

14. Apparatus as recited in claim 13 wherein said die cutting means are downstream of said vacuum cylinder in said first direction, and die cut the sheet without die cutting the transfer tape.

15. Apparatus as recited in claim 13 wherein said cutting means comprises a cut-off cylinder positioned with respect to said vacuum cylinder so that said vacuum cylinder comprises an anvil for said cut-off cylinder.

16. Apparatus as recited in claim 13 wherein the sheet is in continuous format, in the form of a paper web, and further comprising means, downstream of said printing means, die cutting means, and vacuum cylinder in the first direction, for severing the paper web into individual sheets.

17. Apparatus as recited in claim 13 wherein the sheet is in continuous format, in the form of a web of paper, and further comprising means, upstream of said vacuum cylinder in the first direction, for perling the web to form the web into individual forms.

18. Apparatus as recited in claim 13 further comprising roller means for feeding the web of transfer tape from a roll of transfer tape to said cutting means, said roller means comprising at least one roller having a release surface thereof of material which will not adhere to transfer tape adhesive, the transfer tape passing with the adhesive thereof in contact with the release surface of said roller.

* * * * *